US011230022B2

(12) United States Patent
Halmut

(10) Patent No.: US 11,230,022 B2
(45) Date of Patent: Jan. 25, 2022

(54) HAIR CONTAINER AND KIT FOR A HAIR CUTTING APPLIANCE

(71) Applicant: KONINKLIJKE PHILIPS N.V., Eindhoven (NL)

(72) Inventor: Ishay Halmut, Eindhoven (NL)

(73) Assignee: KONINKLIJKE PHILIPS N.V., Eindhoven (NL)

( * ) Notice: Subject to any disclaimer, the term of this patent is extended or adjusted under 35 U.S.C. 154(b) by 109 days.

(21) Appl. No.: 15/748,665

(22) PCT Filed: Jul. 26, 2016

(86) PCT No.: PCT/EP2016/067731
§ 371 (c)(1),
(2) Date: Jan. 30, 2018

(87) PCT Pub. No.: WO2017/021202
PCT Pub. Date: Feb. 9, 2017

(65) Prior Publication Data

US 2018/0222068 A1 Aug. 9, 2018

(30) Foreign Application Priority Data

Aug. 4, 2015 (EP) ..... 15179703

(51) Int. Cl.

| | |
|---|---|
| ***B26B 19/44*** | (2006.01) |
| ***B26B 19/20*** | (2006.01) |
| ***B26B 19/38*** | (2006.01) |
| ***A45D 24/36*** | (2006.01) |

(52) U.S. Cl.
CPC ..... *B26B 19/44* (2013.01); *B26B 19/20* (2013.01); *B26B 19/3813* (2013.01); *A45D 24/36* (2013.01)

(58) Field of Classification Search
CPC ..... B26B 19/44; B26B 19/20; B26B 19/22; B26B 19/3806; B26B 19/3813; B26B 19/48; A45D 24/32; A45D 24/36
USPC ..... 30/41, 41.6, 233.5, 124, 125, 133, 201, 30/537; D28/52–54
See application file for complete search history.

(56) References Cited

U.S. PATENT DOCUMENTS 621,439 A * 3/1899 Watson ..... B26B 19/3813 30/132
1,528,430 A * 3/1925 Josten ..... B26B 19/44 30/133
1,560,347 A * 11/1925 Gambon ..... A45D 24/36 132/212
1,603,237 A * 10/1926 Fisher ..... B26B 19/20 30/132

(Continued)

FOREIGN PATENT DOCUMENTS

CN 101190529 A 6/2008
CN 201783950 U 4/2011

(Continued)

*Primary Examiner* — Evan H MacFarlane

(57) ABSTRACT

A hair container for a hair cutting appliance includes a container housing having a hair compartment for accommodating cut hair sections, and an attachment portion for releasably attaching the hair container to a hair cutting appliance. The attachment portion is configured to attach the hair container to the hair cutting appliance when an attachment comb is attached to the hair cutting appliance.

20 Claims, 6 Drawing Sheets

(56) References Cited

U.S. PATENT DOCUMENTS 2,180,738 A * 11/1939 Hogg ..... B26B 19/38 30/41.6
2,185,042 A * 12/1939 Strong ..... B26B 19/44 15/339
2,220,597 A * 11/1940 Burns ..... B26B 19/38 30/41.6
2,223,410 A 12/1940 Eugene
2,916,820 A * 12/1959 Clark ..... B26B 19/20 30/201
3,035,346 A 5/1962 Campbell
3,348,308 A * 10/1967 Andis ..... B26B 19/44 30/133
3,384,919 A * 5/1968 Jording ..... B26B 19/44 15/339
3,979,825 A * 9/1976 Baumann ..... B26B 19/44 30/133
4,077,122 A * 3/1978 Rollor, Jr. ..... B26B 19/20 30/133
4,216,581 A * 8/1980 Van Slooten ..... B26B 19/42 30/133
4,622,745 A * 11/1986 Wahl ..... B26B 19/20 30/201
4,776,095 A * 10/1988 Tsujimoto ..... B26B 19/20 30/201
4,843,717 A * 7/1989 Crane ..... B26B 19/44 30/133
5,050,304 A * 9/1991 Fujikawa ..... B26B 19/06 30/196
5,050,305 A * 9/1991 Baker ..... B26B 19/06 30/201
5,054,199 A * 10/1991 Ogawa ..... B26B 19/06 30/200
5,084,974 A * 2/1992 Sukow ..... B26B 19/20 30/201
5,185,931 A * 2/1993 Fujikawa ..... B26B 19/20 30/195
5,377,411 A * 1/1995 Andriotis ..... B26B 19/44 30/133
5,960,515 A * 10/1999 Lu ..... A45D 24/32 119/600
6,076,263 A * 6/2000 Andis ..... B26B 19/06 30/210
6,279,234 B1 8/2001 Chaouachi
6,571,478 B1 * 6/2003 Romani ..... B26B 19/44 30/132
6,739,053 B2 5/2004 McCambridge
6,968,623 B2 * 11/2005 Braun ..... B26B 19/20 30/201
7,040,021 B2 5/2006 Talavera
8,484,853 B1 * 7/2013 Laube ..... B26B 19/44 30/133
2003/0233754 A1 * 12/2003 Braun ..... B26B 19/20 30/201
2004/0045168 A1 3/2004 Talavera
2006/0230619 A1 * 10/2006 Williams ..... B26B 19/44 30/133
2009/0223058 A1 * 9/2009 Coleman ..... B26B 19/3813 30/41.6
2011/0185578 A1 * 8/2011 Landrie ..... A45D 44/00 30/133
2011/0308035 A1 * 12/2011 Casper ..... A01K 13/001 15/344

FOREIGN PATENT DOCUMENTS

EP 1216800 A2 6/2002
EP 2433763 A1 3/2012
FR 2809049 A1 11/2001
WO 2015028330 A1 3/2015

* cited by examiner

FIG.7
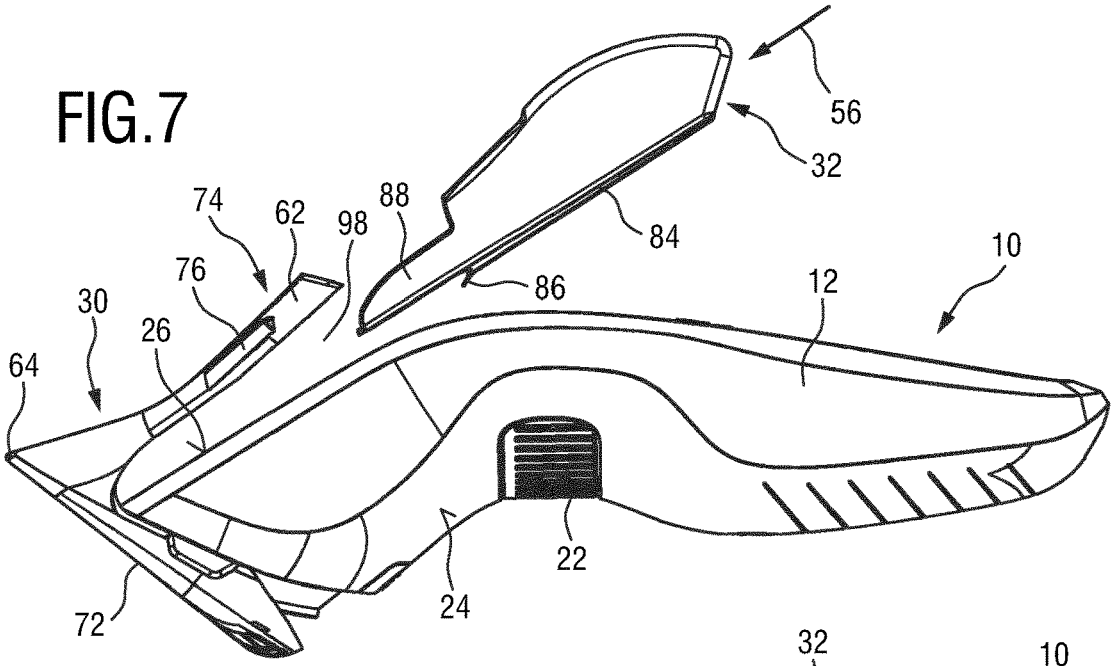
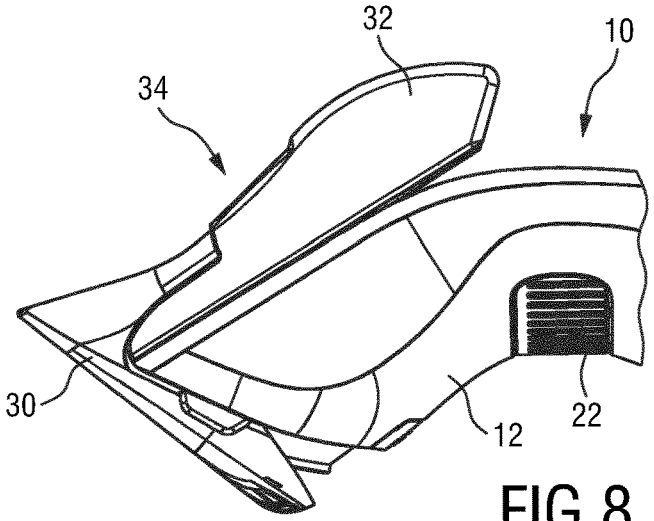
FIG.8
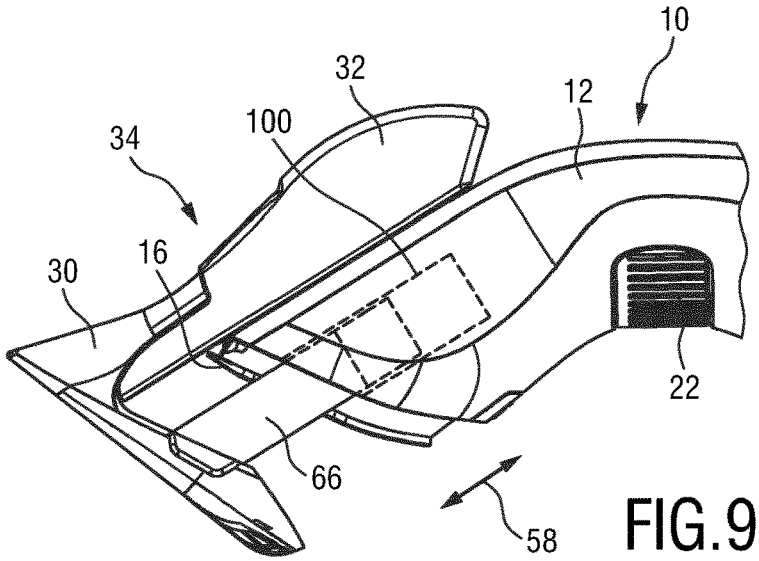
FIG.9

HAIR CONTAINER AND KIT FOR A HAIR CUTTING APPLIANCE

This application is the U.S. National Phase application under 35 U.S.C. § 371 of International Application No. PCT/EP2016/067731, filed on Jul. 26, 2016, which claims the benefit of European Application No. 15179703.2 filed on Aug. 4, 2015. These applications are hereby incorporated by reference herein.

FIELD OF THE INVENTION

The present disclosure relates to a hair container for a hair cutting appliance and to an attachment kit for a hair cutting appliance, particularly for an electrically operated hair cutting appliance, the attachment kit comprising a hair container and an attachment comb. Further, the present disclosure relates to a hair cutting appliance that is fitted with a respective attachment kit.

BACKGROUND OF THE INVENTION

Hair cutting appliances, particularly electric hair cutting appliances, are generally known and may include trimmers, clippers and shavers, for instance. Electric hair cutting appliances may also be referred to as electrically powered hair cutting appliances. Electric hair cutting appliances may be powered by electric supply mains and/or by energy storages, such as batteries, for instance. Electric hair cutting appliances are generally used to shave or trim (human) body hair, in particular facial hair and head hair to allow a person to have a well groomed appearance. Frequently, electric hair cutting appliances are used for cutting animal hair.

EP 2 433 763 A1 discloses a hair cutter comprising a body housing, a motor arranged in the body housing, a stationary cutter fixed to the body housing, a movable cutter arranged to be driven by the motor to slide against the stationary cutter, a hair collection chamber for collecting hairs sheared with the movable cutter and the stationary cutter, and a cover adapted to be slid along an outer surface of the body housing to open and shut the hair collection chamber.

US 2004/045168 A1 discloses a hair trimming apparatus for trimming the distal ends of hair drawn therethrough, the apparatus comprising a body assembly having a handle end and having a head end; a motor mounted in said body assembly adapted for communication with an electric power source; and a cutting head assembly positioned upon said head end of said body assembly, said cutting head assembly comprising an internal containment area that holds the cut ends of hair shafts drawn through the device and trimmed. In a further embodiment disclosed in US 2004/045168 A1, a removable hair collecting tray arranged to be inserted into a housing a of the cutting head assembly is presented.

FR 2 809 049 A1 discloses a hair cutting appliance comprising a fan that is arranged to blow air towards a guide so as to position the hair at a defined orientation for cutting, wherein a hair collection container for cut hair is provided which is fixed to a housing of the hair cutting appliance.

Hair collection is an important feature for hair trimming appliances in both professional and home environments. Typically, when hair is shaved or trimmed, the cut hair sections would fall down from a cutting site in an arbitrary fashion. This may involve falling to the floor which may be the preferred option in many applications. However, typically also cut hair sections tend to adhere to the clothes or even the skin of the currently treated person or even the operator of the hair cutting appliance. This may cause additional cleaning efforts and increase the total amount of time required for accomplishing a hair cutting operation. Further, in professional environments, such as at a hair dresser or barber shop, a customer typically has to wear a poncho-like protective garment which may cause a certain level of discomfort. In home environments, typically towels are used to cover for instance the neck portion of a person whose hair is to be cut. Typically, such protective towel or similar protective scarf or blanket is only used one time before being washed. Further, the shorter the cut hair sections are, the more they tend to stick to pieces of clothing, carpets, towels, blankets and such like.

Further, hair cutting appliances are known that implement so-called spacing combs so as to set a desired cutting length. Hence, hair trimming may be greatly facilitated, e.g. by setting the cutting length to 6 mm (millimeter), 9 mm, 12 mm, etc. Further, also so-called adjustable spacing combs are known. In this context, U.S. Pat. No. 6,968,623 B2 discloses a hair trimmer comprising a body, a cutting head including a blade set, an adjustable comb, wherein the comb is movable with respect to the blade set, an electric motor for driving the blade set to effect a cutting action, and an actuator assembly that is capable of moving the comb with respect to the blade set between a fully retracted position and a fully extended position, the actuator assembly comprising a comb carriage, a comb button connected to the comb carriage, wherein the comb button is actuatable to adjust a position of the comb relative to the blade set, and a lock button movable with respect to the comb button, wherein the lock button selectively prevents and permits movement of the comb relative to the body. Consequently, manual adjustment of the length of the comb is enabled.

On the one hand, adjustable combs improve the performance and enlarge the field of application of hair cutting appliances. Particularly trimming operations may be considerably simplified. On the other hand, spacing combs pose further challenges for hair catching or hair collecting units as disclosed in the above EP 2 433 763 A1. On the one hand, an adjustable spacing comb requires a considerable installation space at or adjacent to the cutting head of a hair cutting appliance. Basically the same is the case for hair catching or hair collecting units. Further, when a spacing comb is attached, the working distance and working orientation of the hair cutting appliance with respect to the skin of the to-be-groomed subject somewhat varies with the set cutting length. This may have some influence on the performance of hair collecting units. Further, for some certain applications, such as hair styling operations, good visibility of the actual cutting site is of major importance. Therefore, any attachment part would somewhat obstruct the blade head and mitigate the visibility of the cutting edge.

There is thus still room for improvement in hair collecting approaches and units for hair cutting appliances.

SUMMARY OF THE INVENTION

It is an object of the present invention to provide a hair cutting appliance, a hair container for a hair cutting appliance, and an attachment kit for a hair cutting appliance implementing a respective hair container that cope with and may overcome at least some of the above-mentioned issues. In particular, it is an object to provide a hair container for a hair cutting appliance that is easy to handle and operate and that may provide the hair cutting appliance with an improved hair collecting or hair catching performance. Furthermore, it would be beneficial to present a hair container for a hair cutting appliance that is easy to manufacture, assemble and operate.

Further, it would be advantageous to provide a hair cutting appliance that can be fitted with a respective hair container, wherein the hair cutting appliance exhibits improved hair cutting performance that involves a reduction of cleaning or hair removing efforts at the treatment site. It would be further beneficial to present a respective hair container and a hair cutting appliance that is fitted with a hair container, wherein also cutting length adjustment is enabled such that, even though hair catching or collecting capability is provided, further comfort features may be implemented that improve the overall performance of the hair cutting appliance.

In a first aspect of the present disclosure, a hair container for a hair cutting appliance comprising an attachment comb is presented, the hair container comprising:

a container housing comprising a hair compartment for accommodating cut hair sections, and an attachment portion for attaching the hair container to an attachment comb of the hair cutting appliance, wherein the attachment portion is arranged to attach the hair container to the hair cutting appliance in a mediate fashion, when the attachment comb is attached to the hair cutting appliance.

This aspect is based on the insight that it is particularly beneficial when the hair container is—so to say—attached to the hair cutting appliance in a mediate fashion. In other words, the hair container may be arranged to be positioned at a rear side of a housing or housing portion of the hair cutting appliance as an extension or an add-on of the attachment comb. As used herein, the rear side of the housing portion may be regarded as the side which is facing away from a cutting area when the hair cutting appliance is in use for trimming hair.

In accordance with the above aspect, the hair container does not have to be directly coupled or attached to the housing of the hair cutting appliance. Consequently, both the attachment comb and the hair container can be attached to the hair cutting appliance in one step. Consequently, changing attachments of the hair cutting appliance is considerably simplified since only one interface is required at the hair cutting appliance. Further, when the hair cutting appliance is in use for styling operations, neither the attachment comb nor the hair container obstructs the cutting zone. Therefore, sufficient visibility of the to-be-styled hair portion or beard portion is ensured.

Further, in accordance with the above aspect, the attachment comb and the hair container comprise a common interface. Further, an attachment interface between the attachment comb and the hair cutting appliance is provided. There is no direct interface between the hair container and the (body portion of the) hair cutting appliance, i.e. an interface where the hair container and the housing of the hair cutting appliance are directly attached to one another. In other words, the attachment comb may be regarded as an indirect interface portion between the hair container and the housing of the hair cutting appliance. A further advantage of this setting is that the hair container may be moved synchronously with the attachment comb. This is particularly beneficial when the attachment comb is arranged as an adjustable attachment comb that is operable to adjust a cutting length of the hair cutting appliance. In other words, in accordance with at least some embodiments as disclosed herein, a relative position and a relative orientation between the hair container and a top surface (contact surface) of the attachment comb is maintained even when the attachment comb is moved with respect to the housing portion of the hair cutting appliance for length adjustment.

The attachment portion may be arranged for releasably attaching the hair container to the hair cutting appliance. In one embodiment, the hair container is arranged to be attached to a releasable attachment comb. In one embodiment, the hair container is arranged to be attached to a non-releasable attachment comb. Hence, the hair container may be considered as an upgrade hair container for hair cutting appliances, and for hair cutting systems involving an appliance and at least one spacing comb. This may involve units wherein the spacing comb is fixedly attached to the appliance and units wherein at least one spacing comb is provided that may be attached to the appliance in a releasable fashion. Either type of combs may involve fixed combs and (cutting length) adjustable combs. Since the hair container provides a bypass interface with attachment combs and therefore a mediate interface with hair cutting appliances, the hair container may be marketed individually or as a component of a respective kit.

In one embodiment, the hair container is arranged to be at least sectionally interposed between a housing portion of the hair cutting appliance and the attachment comb, when the attachment comb is attached to the hair cutting appliance. Hence, the hair container may be arranged to receive hairs from a rear or tail portion of the attachment comb at the rear side of the housing portion. Needless to say, when the attachment comb is arranged as an adjustable attachment comb, at least a main skin-contacting portion of the attachment comb is arranged at the hair cutting appliance in a fashion movable with respect to the housing portion thereof. Hence, both the attachment comb and the hair container may be moved with respect to or slide along the rear wall or portion of the housing of the hair cutting appliance.

In a further embodiment of the hair container, the attachment portion comprises at least one locking element that is arranged to lock the hair container at the attachment comb in a releasable fashion. The at least one locking element may be arranged as a snap locking element. The at least one locking element may comprise a shape selected from the group consisting of snap hooks, recesses, protrusions, indentations, snap-locks, spring-locks, snap lids, latches, catches, etc. Preferably, the at least on locking element is integrally shaped with the hair container. Therefore, preferably at least one flexible or at least partially deformable section of the hair container is provided which enables mounting the hair container to the attachment comb in a snap-on or snap-in fashion. Further, the hair container may preferably be attached to and detached from the attachment comb in a tool-free fashion. Consequently, quick action assembling and disassembling is achieved.

Generally, locking elements may be arranged in a force fit and/or tight fit (positive locking) fashion. Furthermore, locking elements involving hook and loop fasteners may be utilized. For instance, bayonet joint-type locking elements may be envisaged. In the alternative, non-mechanical locking elements may be implemented. For instance, magnetic locking elements (and mating elements) may be utilized.

In a further refined embodiment, the attachment portion comprises at least two lateral locking elements that are spaced apart from one another and that are arranged to engage mating snap lock elements at the attachment comb. To this end, the attachment comb is preferably provided with a frame portion that serves as basis for comb ribs and the mating snap lock elements. Therefore, also the mating snap lock elements (snap-on or snap-in elements) at the attachment comb may be integrally shaped with the attachment comb. Consequently, both the attachment comb and the hair container may be arranged as an integrally shaped one-piece part, respectively.

By way of example, the hair container may comprise two mounting recesses that are laterally spaced from one another and that are arranged on inwardly-facing lateral surfaces of the hair container. Further, the attachment comb may comprise two corresponding mounting protrusions that are laterally spaced from one another and that are arranged on outwardly facing lateral surfaces of the frame or frame portion of the attachment comb.

Further, in another embodiment of the hair container, the attachment portion comprises at least one alignment element that is arranged to engage a mating positioning element at the attachment comb. The alignment element and the positioning element ensure that the hair container and the attachment comb may be attached to one another in the desired relative orientation. An incorrect installation may be therefore avoided. Further, the at least one alignment element and the at least one corresponding mating positioning element may indicate a correct approaching direction/orientation which may further facilitate attaching the hair container to the attachment comb. Also a reversed or inverted mounting of the hair container can be prevented in this way.

In yet another embodiment, the hair container is arranged, in the mounted state, to be moved with the attachment comb relative to the housing porting of the hair cutting appliance when the attachment comb is moved for comb length adjustment. Consequently, in accordance with this embodiment, there is no fixed connection between the hair container and the hair cutting appliance. Further, the hair cutting appliance may be upgraded with the hair container by attaching a respective attachment comb thereto. Hence, when the hair cutting appliance already provides an interface contour for the attachment comb, by attaching the attachment comb that is arranged to receive the hair container, the hair container may be mounted to the hair cutting appliance.

In yet another embodiment, the hair container further comprises a guide wall that is preferably shovel blade shaped, a front end of which, in the mounted state, is arranged between rear ribs of the attachment comb and a rear side of the housing portion of the hair cutting appliance in close proximity to the rear side. In other words, the guide wall may at least partially reach under the comb that is somewhat offset from the rear side of the housing portion of the hair cutting appliance. In other words, the design of the guide wall may be considered as being skid-plate shaped. Preferably, the front end of the guide wall is tapered. In some embodiments, the front end of the guide wall contacts the rear side of the housing portion of the hair cutting appliance. Generally, a remaining gap between the housing portion and the front end of the guide wall is preferably minimized so as to prevent hairs from entering the gap and, consequently, from being not trapped or collected in the hair compartment.

In yet another embodiment, the hair container further comprises two lateral catching arms which laterally delimit a hair guiding channel. The hair guiding channel may be jointly defined by the two lateral catching arms and the guide wall of the hair container. Further, at least a portion of the rear side of the housing portion may form part of the hair guiding channel.

Preferably, the lateral locking elements are arranged at or adjacent to the lateral catching arm, particularly at top end portions thereof. The laterally catching arms may be considerably flexible, due to their design, which facilitates mounting the hair container to the attachment comb. By laterally deflecting the lateral catching arms, the locking elements of the hair container may engage the mating snap lock elements of the attachment comb.

In still another embodiment of the hair container, the hair compartment is arranged as a rigid container, particularly as a rigid bucket-like compartment. In other words, the hair compartment may be arranged as a pocket or basket. In yet another embodiment of the hair container, the hair compartment is arranged as a flexible container, particularly as a flexible backpack-like compartment. Consequently, the flexible hair compartment may be formed of fabric cloth, meshed materials, and suchlike. In accordance with this embodiment, also paper-based, cellulose-based, or similarly materials may be used. Hence, the hair compartment may be arranged in a disposable fashion.

Further, the hair compartment is preferably arranged and positioned such that hairs may fall therein when the hair cutting appliance is moved in an upward movement for cutting or trimming hair. When the hair cutting appliance, the attachment comb and the hair container being attached thereto, is upwardly moved, cut hair sections may enter the hair compartment in a gravity-supported fashion. Generally, the hair guiding channel is designed to guide the hairs into the hair compartment where they may be compressed. This has the benefit that no additional active hair transfer units are required, such as blowers, conveying fans, etc.

In another aspect of the present disclosure, an attachment kit for a hair cutting appliance is presented, the attachment kit comprising:

- a hair container in accordance with at least one embodiment as disclosed herein,
- an attachment comb, preferably a snap-lock mounting attachment comb, that is arranged to be attached to the hair cutting appliance,
- wherein the hair container is mounted to the attachment comb, and wherein the hair container is attached to hair cutting appliance in a mediate fashion, when the attachment comb is attached to the hair cutting appliance.

In this way, an upgrade kit for hair cutting appliances may be provided which improves both cutting operation and hair catching performance when the hair cutting appliance is used for trimming purposes. Preferably, the attachment comb comprises a receptacle for the hair container so as to fasten the hair container to the attachment comb in a releasable fashion. Both the attachment comb and the hair container may be detached from the hair cutting appliance. Consequently, also the attachment comb may be referred to as a releasable attachment comb. If this is the case, the hair cutting appliance is suited for styling operations and shaving operations. When the attachment kit is mounted, the hair cutting appliance is particularly suited for trimming operations.

In alternative embodiments, the attachment comb may be arranged as a permanently attached integrated comb. Hence, the attachment comb may be mounted to the appliance in a non-releasable fashion.

In one embodiment of the attachment kit, the attachment comb is an adjustable attachment comb, wherein the attachment comb is arranged to engage an adjustment drive of the hair cutting appliance, particularly to engage a movable adjustment carriage of the adjustment drive. To this end, the attachment comb and the adjustment drive may be configured for a snap-on or snap-in engagement. In accordance with this embodiment, the attachment kit also may be referred to as adjustable (extendable or extractable) attachment kit. When the adjustment comb is moved for adjustment, also the hair container is moved with respect to the housing portion of the hair cutting appliance. This may improve hair catching or hair collection.

In alternative embodiments, the attachment comb may be arranged as a non-adjustable attachment comb. Hence, the attachment comb may provide a fixed cutting length. Consequently, for length variation, the kit may comprise more than one attachment comb having different length properties (e.g. 3 mm, 6 mm and 12 mm). If this is the case, the attachment combs are preferably arranged as releasable or detachable attachment combs. In another embodiment of the attachment kit, the attachment comb comprises a tail portion which is at least partially offset from the housing portion of the hair cutting appliance, wherein the hair container, in its mounted state, at least partially engages an offset gap between the tail portion and the housing portion. By way of example, the tail portion of the attachment comb may be rearwardly curved, for instance bent away from the rear side of the housing of the hair cutting appliance. Since the hair container, particularly the guide wall thereof, may engage the resulting offset gap, hair transfer may be facilitated. Further, the hair container may be arranged between the tail portion and the housing portion which may lead to a somewhat protected mounting position of the hair container.

In yet another embodiment of the attachment kit, the attachment comb is arranged as an integrally shaped injection moulding part, wherein the hair container is arranged as an integrally shaped injection moulding part. Consequently, in some embodiments, the attachment kit consists of only two parts, namely the attachment comb and the hair container. This may considerably simplify manufacturing and handling. Any locking or mating elements may be integrally shaped. Required flexibility for the mounting and dismounting action may be provided by the inherent flexibility of the injection-mouldable material (injection-moulding plastic material). Preferably, at least some on the (snap-on or snap-in) mounting elements may be obtained by providing undercuts and the moulding tool, wherein demoulding involves a forced demoulding at the undercuts so as to disengage the recessed or elevated mounting elements from the mould (without the need of sliders, etc.). This may further facilitate the manufacturing process and reduce manufacturing/tooling costs.

In yet another embodiment of the attachment kit, the attachment comb and the hair container jointly define a hair guiding channel through which, in the mounted state, cut hair sections are guided to be received in the hair compartment in the hair container. Preferably, the hair guiding channel has a downward orientation when the hair cutting appliance is moved upwardly to cut or trim hair. Further, at least a part or section of the rear side of the housing portion of the hair cutting appliance may also form part of the hair guiding channel. When the attachment kit is moved with respect to the housing portion for length adjustment, also the corresponding wall portion that forms part of the hair guiding channel is adapted accordingly. Generally, the hair compartment of the hair container is arranged to receive and accommodate hair strands, hair filaments, and further wear and residue generated in the hair cutting action.

In accordance with yet another aspect of the present disclosure, a hair cutting appliance, particularly a hair trimmer or clipper, is presented, the hair cutting appliance comprising a housing portion, a cutting unit including a blade set, and an attachment kit in accordance with at least one embodiment as disclosed herein. Preferably, the hair cutting appliance is a hand-held electrically powered hair cutting appliance. Typically, the hair cutting appliance comprises an elongated housing and a cutting head at a top end thereof where the blade set is provided. Typically, the blade set comprises at least one stationary blade and at least one movable cutter blade that is operable to be moved with respect to the stationary blade to cut hair. The elongated housing further comprises a bottom end which is opposite to the top end thereof. Further, a front side and a rear side are provided. When the hair cutting appliance is in operation, typically the top side, where the blade set is arranged, contacts the to-be-groomed skin portion in a direct or mediate (i.e. via the attachment comb) fashion. The front side is typically facing the skin portion, when the appliance is in use. Consequently, the rear side is typically facing away from the skin when the hair cutting appliance is in operation. Therefore, the hair container, particularly the hair compartment, is arranged at the rear side of the housing portion. The above-described top side, bottom side, front side and rear side are supplemented by (two) lateral sides.

BRIEF DESCRIPTION OF THE DRAWINGS

These and other aspects of the disclosure will be apparent from and elucidated with reference to the embodiments described hereinafter. In the following drawings

FIG. 7 shows a lateral view of a hair cutting appliance to which an attachment comb is mounted, wherein a hair container is shown in a detached state approaching the attachment comb;

FIG. 8 shows a partial lateral view of the attachment of FIG. 7, wherein the hair container is mounted to the attachment comb, the attachment comb shown in a refracted state;

FIG. 9 shows yet another view of the arrangement of FIG. 8, the attachment comb shown in an extracted state;

DETAILED DESCRIPTION OF THE EMBODIMENTS

Figure 1:
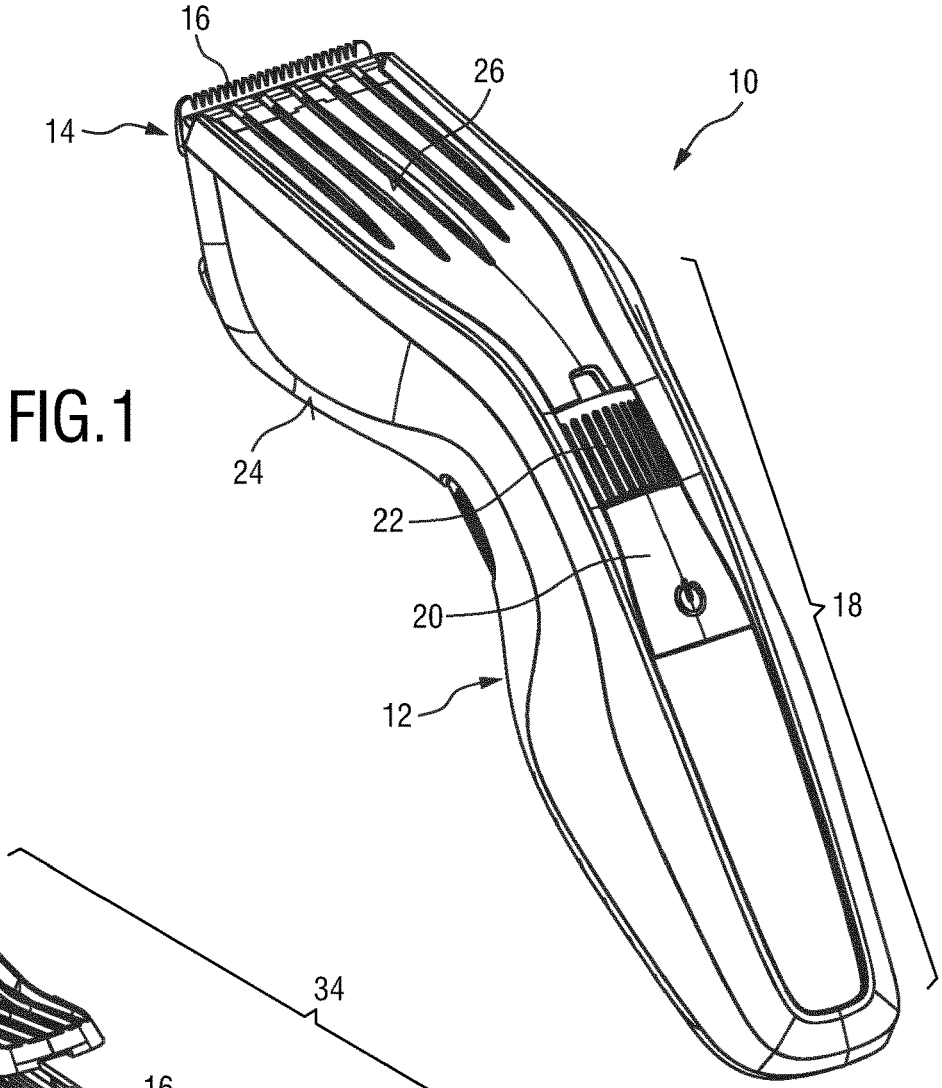
FIG. 1 shows a schematic perspective view of an exemplary embodiment of an electric hair cutting appliance.

FIG. 1 shows a schematic perspective view of a hair cutting appliance 10, particularly an electrically-operated hair cutting appliance 10. The appliance 10 may also be referred to as hair clipper or hair trimmer. The appliance 10 comprises a housing or housing portion 12 having a generally elongated shape. At a first, top end thereof, a cutting unit 14 is provided. The cutting unit 14 comprises a blade set 16. The blade set 16 may comprise a movable blade and a stationary blade that may be moved with respect to each other to cut hair. At a central portion and a second, bottom end of the housing 12, a handle or grip portion 18 may be provided. A user may grasp or grab the housing 12 at the grip portion 18.

The appliance 10 further comprises operator controls. For instance, an on-off switch or button 20 may be provided. Furthermore, in case the appliance 10 is provided with a comb length adjustment mechanism, a length adjustment control 22 may be provided at the housing 12 of the appliance 10. As with the embodiment of FIG. 1, the length adjustment control 22 is arranged as a length adjustment wheel.

A front side of the housing portion 12 is indicated in FIG. 1 by reference numeral 24. An opposite rear side is indicated by reference numeral 26. Consequently, for illustrative purposes, the housing 12 of the hair cutting appliance 10 comprises a top side, where the blade set 16 is mounted, a bottom side that is opposite to the top side, a front side 24 which typically faces the skin of the to-be-groomed subject when the appliance 10 is in operation, and a rear side 26 that is opposite to the front side 24. Further, supplementary lateral sides are present, refer to the viewing orientation of FIG. 7, for instance.

Figure 2:
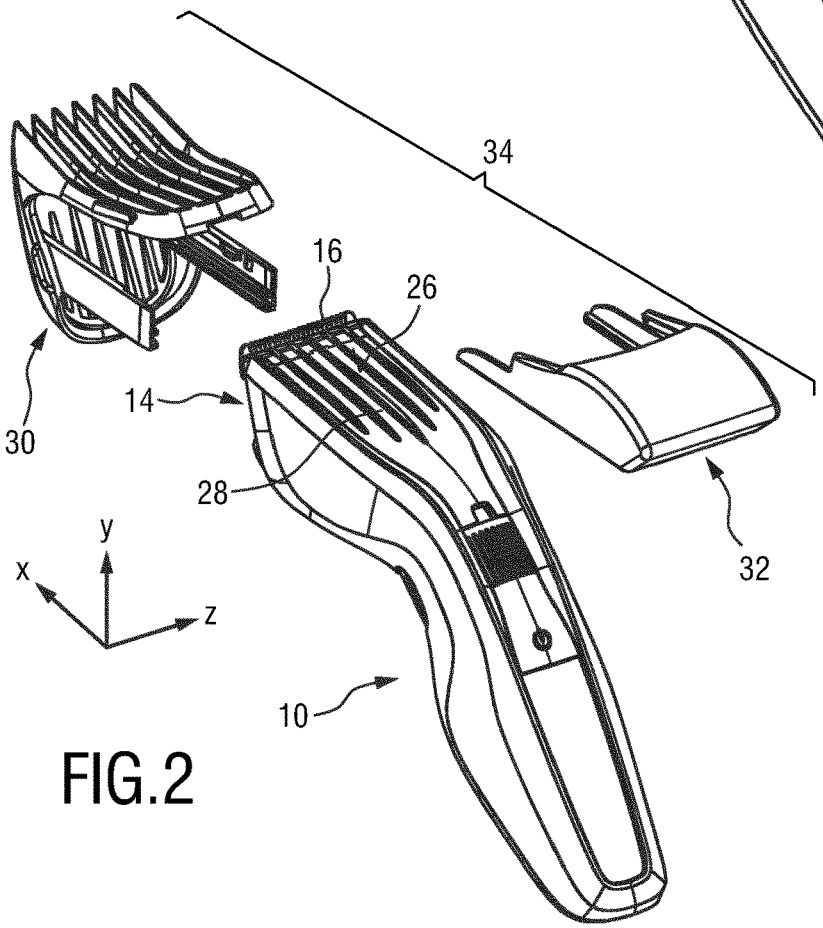
FIG. 2 shows a further view of the appliance of FIG. 1, wherein also an attachment kit including an attachment comb and a hair container is illustrated, the attachment kit shown in a detached exploded state.

Further reference is made to FIG. 2. As shown in at least some Figures herein, for illustrative purposes, a coordinate system (Cartesian coordinate system) X-Y-Z is provided. The coordinate system X-Y-Z is used in the following for describing orientations and locations of components of the hair cutting appliance 10. However, as can be already seen from FIGS. 1 and 2, not in each case a perfect match of components or parts of the appliance 10 with any of the axis X-Y-Z is provided. By way of example, the housing 12 may exhibit an elongated but somewhat curved shape for ergonomic and design reasons. Therefore, a main elongation direction of the housing 12 does not perfectly match the direction of the X-axis. It goes without saying that the skilled person is capable of adapting or, if necessary, transforming or converting the coordinate system X-Y-Z when being confronted with new embodiments, illustrations and/or orientations as the coordinate system X-Y-Z is merely an illustrative means for describing elements of the presented exemplary embodiment of the appliance 10 and their interrelation.

As indicated above, the housing 12 has a main (longitudinal) direction which will be hereinafter associated with the X-axis (length direction). Therefore, the top end and the bottom end of the housing 12 are spaced from one another in the X-direction. Further, the front side 24 and the rear side 26 are basically spaced from one another in the Y-direction. Lateral sides of the housing 12 are basically spaced from one another in the Z-direction.

As shown in FIG. 2 in a detached or exploded state, an attachment comb 30 may be mounted to the appliance 10. In the mounted state, the attachment comb 30 basically spaces the blade set 16 of the cutting unit 14 away from the to-be-treated body portion (in the X-direction). Hence, a defined cutting length (e.g. 6 mm, 9 mm, etc.) may be achieved. Further, a hair container 32 may be attached to the appliance 10. The main purpose of the hair container 32 is to catch and collect cut hair sections so as to minimize the amount of falling-down hairs which may pollute the floor and/or stick at the operator's or the to-be-groomed subject's skin or clothes.

Usage of the hair container 32 may be particularly beneficial for trimming relatively short hair as the resulting (cut) hair sections are considerably short and relatively easy to catch. Further, short hair sections are often experienced as being tickling, particularly in facial regions and also difficult to be removed from clothes, towels, scarfs, etc.

The attachment comb 30 and the hair container 32 may jointly form an attachment kit 34 for the appliance 10. Preferably, the attachment kit 34 is a releasable attachment kit. Further, the attachment kit 34 is arranged for a snap-on or snap-in attachment and detachment. Preferably, the attachment kit 34 improves the appliance's hair trimming performance.

Figure 3:
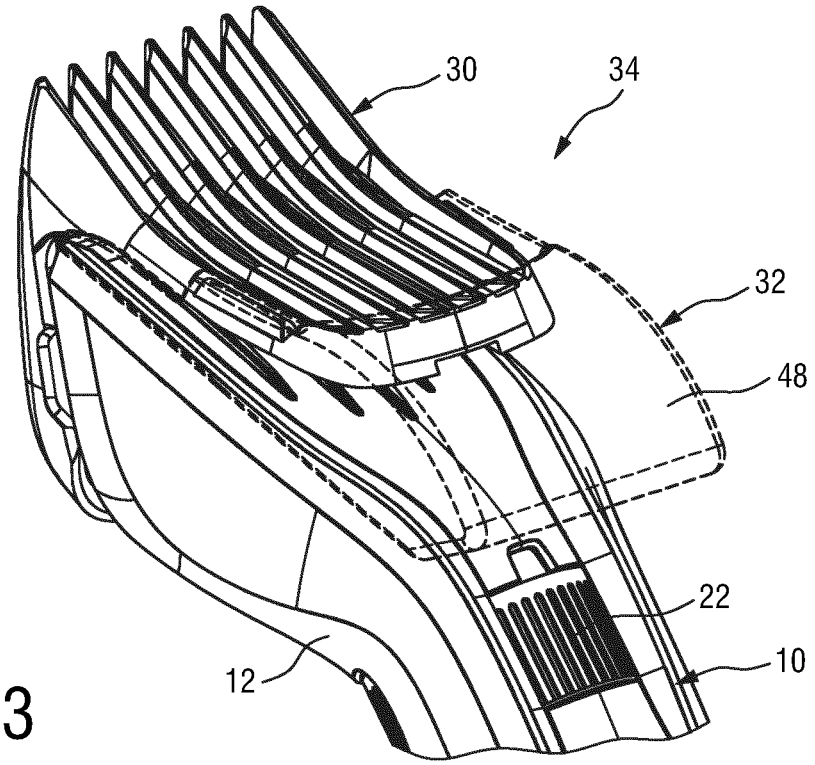
FIG. 3 shows a partial view of the hair cutting appliance of FIG. 2 including the attachment kit, wherein the attachment kit is shown in a mounted state, and wherein the hair container is illustrated in transparent fashion by a broken line representation.
Figure 5:
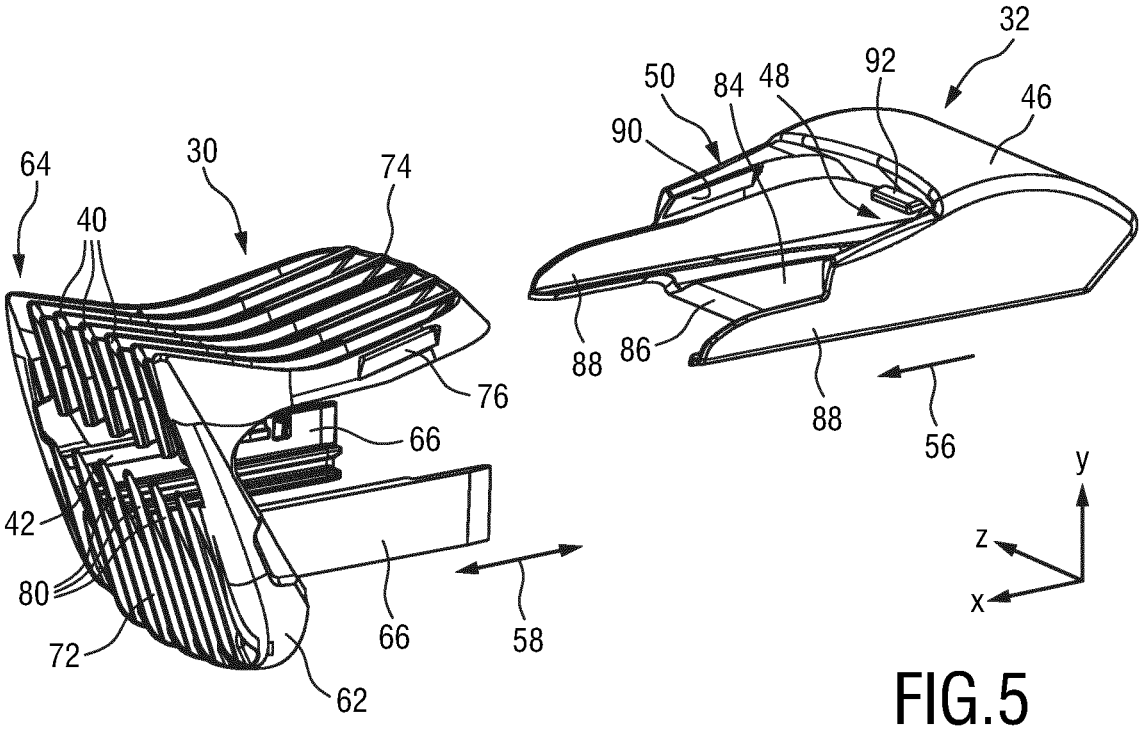
FIG. 5 illustrates a perspective exploded view of an attachment kit for a hair cutting appliance, the kit comprising a hair container and an attachment comb.
Figure 6:
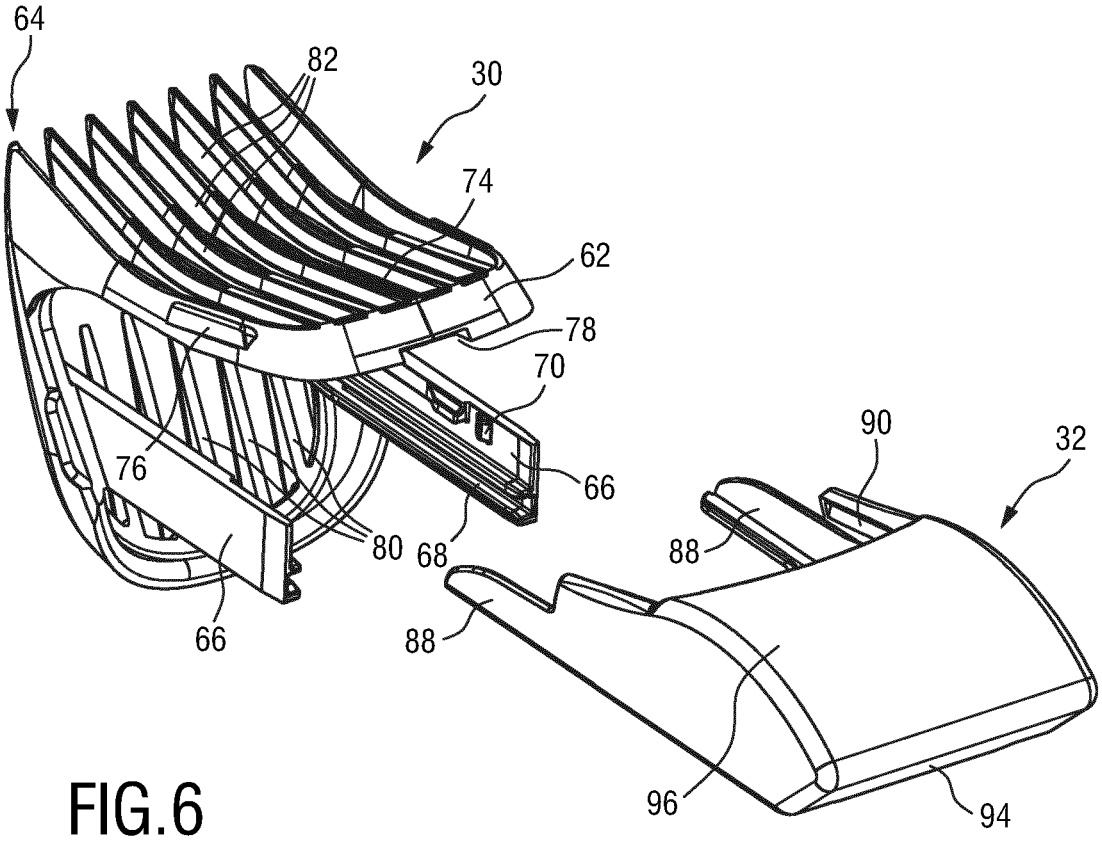
FIG. 6 illustrates a further view of the arrangement of FIG. 5 in another perspective orientation.

FIG. 1 and FIG. 2 show a perspective rear view of the appliance 10. The attachment kit 34 is shown in more detail in the mounted state in FIG. 3 and FIG. 4. FIG. 5 and FIG. 6 illustrate the attachment kit 34 in the detached state. In FIG. 3, a transparent representation of the hair container 32 is provided for illustrative purposes, refer to the dotted line representation. The attachment comb 30 is attached to the appliance 10 at the top side thereof. In the mounted state, the hair container 32 is arranged at the rear side 26 of the housing 12 of the appliance 10.

Figure 4:
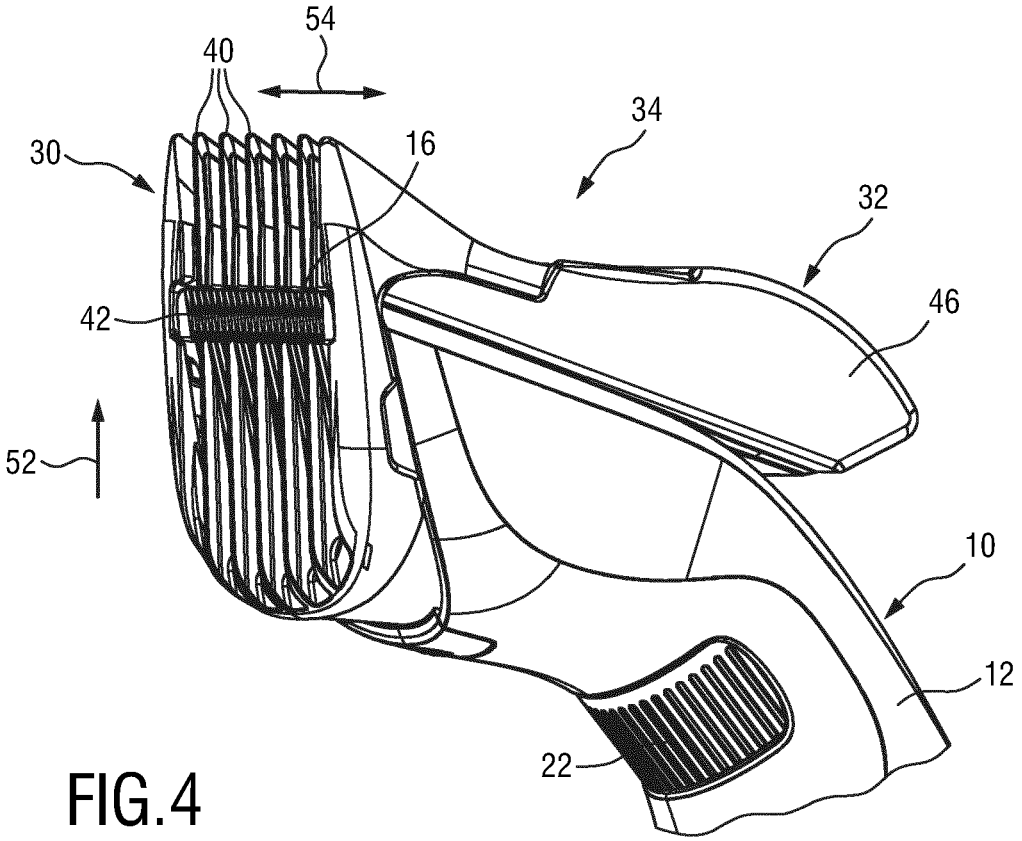
FIG. 4 shows yet another partial view of the arrangement of FIG. 3 in a further (perspective frontal) orientation.

FIG. 4 shows a partial perspective top/frontal/lateral view of the appliance 10 in a state fitted with the attachment kit 34. The attachment comb 30 comprises an arrangement of ribs 40 which further define a window or opening 42 in which, in the mounted state as shown in FIG. 4, the blade set 16 is arranged, particularly a cutting edge thereof. When in use for trimming hair, the appliance 10 is basically moved in a moving or operating direction 52, refer also to FIG. 12. Relative movement between the stationary blade and the movable cutter blade of the blade set 16 is indicated in FIG. 4 by a double-arrow indicated by reference numeral 54. The hair container 32 comprises a container housing 46 which defines and delimits a hair compartment 48 (interior of the container housing 46), refer also to FIG. 3.

As can be further seen in conjunction from FIGS. 3 and 4, the length adjustment control 22 is arranged as an adjustment wheel whose axis of rotation is inclined at a small angle with respect to (or even parallel to) the X-axis, refer also to FIG. 1 and FIG. 2.

For mounting the hair container 32 to the appliance 10, an attachment portion 50 is provided (not shown in FIGS. 3 and 4). The attachment portion 50 enables mounting the hair container 32 to the attachment comb 30. As a consequence, no direct connection or direct mounting between the hair container 32 and the housing 12 of the appliance 10 is provided. Rather, the attachment comb 30 so-to-say "bridges" the housing 12 and the hair container 32. This is beneficial as in this way the hair container 32 is arranged to be movable with the attachment comb 30 when the attachment comb 30 is moved with respect to the housing 12 for adjustment.

A further benefit of this arrangement is that no attachment or interface geometry for the hair container 32 is required at the housing 12. Hence, when the hair container 32 is not required, no disturbing of obstructing elements are present. Consequently, the appliance 10 may be particularly suited for multi-purpose usage, particularly for trimming, shaving and styling. Further, also attachment combs may be mounted to the appliance 10 which are not arranged to receive the hair container 32.

Further reference is made to FIG. 5 and to FIG. 6 each of which showing the attached comb 30 and the hair container 32 of the attachment kit 34 in a separated detached state. FIG. 5 is a perspective top/lateral view. FIG. 6 is a perspective bottom/rear view. In FIG. 5, a mounting direction 56 for the hair container 32 is indicated by reference number 56. In the exemplary embodiment, the mounting direction 56 is inclined at a small angle with respect to (or even parallel to) the X-axis. As with the embodiment of FIG. 5, basically the same applies to an adjustment attachment direction 58 of the attachment comb 30. The double-arrow 58 indicates the moving direction of the adjustment comb 30 with respect to the housing 12, when the adjust comb and, if any, the mounted hair container 32 is/are moved for adjustment.

The attachment comb 30 comprises a comb frame 62 which is arranged as an all-round frame. Between lateral frame sections the ribs 40 are arranged and may define front ribs 80 and rear ribs 82 which are separated from one another by the opening 42. At a most remote top and rear end, the ribs 40 define a tip edge 64 of the attachment comb 30. As with the embodiment of FIG. 5, the rear ribs 82 define the tip edge 64.

Further, the attachment comb 30 comprises a comb attachment including attachment bars 66 extending from the comb frame 62. The attachment bars 66 may be referred to as lateral attachment bars. The attachment bars 66 basically extend in the X-direction from the top side towards the bottom side (refer to the double-arrow 58 of FIG. 5). Inwardly facing lateral sides of the attachment bars 66 are provided with guide elements 68 and snap-lock elements 70 for interaction with respective mating elements at the adjustment drive or mechanism at the appliance 10 for cutting length adjustment.

The ribs 40 of the attachment comb 30 further define a top surface or portion 72 which basically defines a contact surface with the to-be-groomed skin. The top portion 72 is defined by the front ribs 80 and a top portion of the rear ribs 82.

A tail portion 74 of the attachment comb 30 is basically defined by the rear ribs 82 and the respective portion of the comb frame 62. At the tail portion 74, snap lock elements 76 are provided at the comb frame 62. The snap lock elements 76 may be arranged as snap-on or snap-in elements, for instance. In the exemplary embodiment of FIGS. 5 and 6, the snap lock elements 76 are arranged as protruding bars or ribs. Two snap lock elements 76 are provided that are spaced from one another in the lateral direction (Z-direction). Further, as can be best seen in FIG. 6, at the bottom end of the tail portion 74, a positioning element 78 is provided which is arranged as a central bottom recess at the comb frame 62.

The attachment portion 50 of the hair container 32 is arranged to engage the snap lock elements 76 and the positioning element 78 of the attachment comb. As can be further seen from FIG. 5 and FIG. 6, the hair container 32 is arranged in a basket-like or bucket-like fashion. At the front side of the hair container 32, a guide wall 84 is provided which is arranged in close proximity to the rear wall 28 of the housing 12 of the hair cutting appliance 10 in the attached state. At a top end of the guide wall 84, a front edge 86 is provided. Preferably, the front edge 86 is arranged as a tapered front edge. The hair container 32 further comprises two lateral catching arms 88 at opposite lateral ends thereof. The lateral catching arms 88 basically extend in the X-direction. The lateral catching arms 88 and, at least partially, the guide wall 84 are arranged to reach under the tail portion 74 of the attachment comb 30.

The attachment portion 50 of the hair container 32 comprises snap locking elements 90 which are arranged as recesses. The snap locking elements 90 may be arranged as snap-on or snap-in locking elements 90. The snap locking elements 90 are arranged to engage the snap lock elements 76 (mating snap-on or snap-in elements) of the attachment comb 30. The snap locking elements 90 are arranged at lateral ends of the container housing 46 at or adjacent to the lateral catching arms 88. The hair container 32 further comprises an alignment element 92 which is arranged to engage the positioning element 78 of the attachment comb 30. The alignment element 92 is arranged as a protruding alignment tab at the container housing 46.

As can be further seen from FIG. 6, the container housing 46 of the hair container 32 further comprises a bottom wall 94 and a rear wall 96. The bottom wall 94, the rear wall 96, the guide wall 84 and the lateral catching arms 88 jointly define the bucket-like shape of the hair compartment 48. At the rear wall 96, particularly the top end thereof, the alignment element 92 is arranged.

Further reference is made to FIG. 7, FIG. 8 and to FIG. 9. FIG. 7 illustrates a state of the appliance 10 wherein the attachment comb 30 already has been mounted to the housing 12. As can be seen from the side view of FIG. 7, the tail portion 74 is at least slightly offset or bent away from the rear side 26 of the housing 12. Consequently, an offset gap 98 is defined between the tail portion 74 and the rear side 26. The hair container 32 is shown in FIG. 7 in an approaching state, refer to the mounting direction 56. The lateral catching arms 88 and, at least partially, the guide wall 84 including the front end 86 may be inserted in the offset gap 98 to mount the hair container 32 to the attachment comb 30. Mounting the hair container 32 also involves engaging the snap lock element 76 with the snap locking elements 90, and engaging the positioning element 78 with the alignment element 92. Snap-on or snap-in mounting enables repetitive attachment and detachment, for instance for emptying the hair compartment 48.

FIG. 8 is a partial lateral view of the arrangement of FIG. 7, wherein the hair container 32 is shown in the final attached state. As already indicated above, preferably the attachment comb 30 is arranged as an adjustable attachment comb 30. Consequently, the adjustment comb 30 is shown in FIG. 9 in an extended or extracted state, whereas FIG. 8 illustrates basically the same arrangement in a retracted state. As can be seen from FIG. 8 and FIG. 9, for length adjustment, both the adjustment comb 30 and the hair container 32 are jointly moved in the adjustment direction 58 with respect to the housing 12 of the appliance 10. For length adjustment, the attachment bars 66 of the attachment comb 30 are inserted in the housing 12 and engage a mounting receptacle 100. To this end, the guide elements 68 and the snap-lock elements 70 of the attachment bars 66 may be utilized, refer also to FIG. 6.

Adjustment may be effected by operating the length adjustment control 22. The adjustment mechanism may be a manually operated mechanism or a motor powered adjustment drive. Hence, the user may either directly retract or extract the adjusted attachment comb 30 or may operate or control a motor which acts as an adjustment drive motor.

Figure 10:
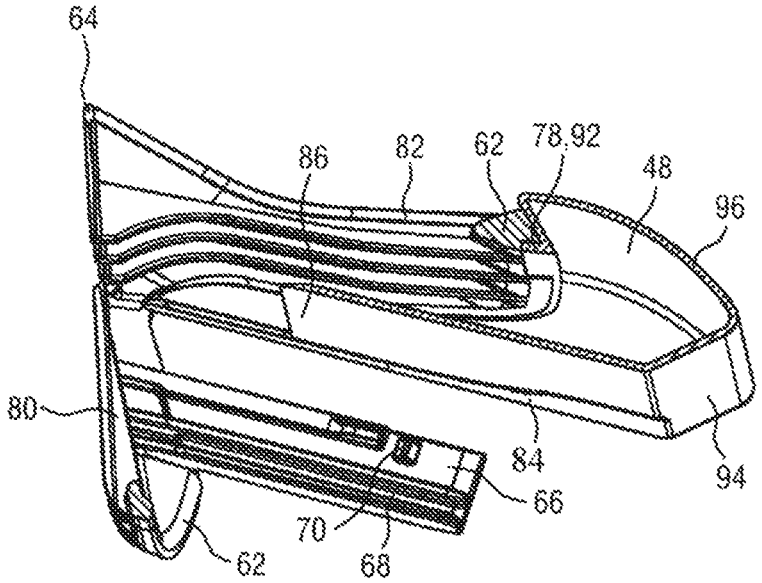
FIG. 10 shows a perspective view of a (longitudinal) cross-section of an attachment kit for a hair cutting appliance.
Figure 11:
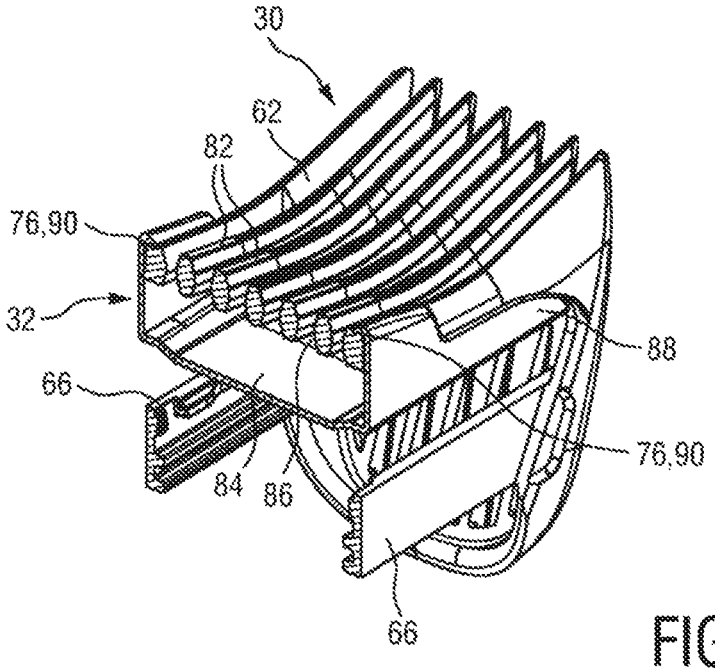
FIG. 11 shows yet a further (transversal) cross-sectional view of the arrangement of FIG. 10 in another viewing orientation.

Further reference is made to FIG. 10 and to FIG. 11 illustrating cross-sectional perspective views of the attachment kit 34 wherein the attachment comb 30 and the hair container 32 are shown in their engaged state attached to one another. As can be best seen from FIG. 10, the protruding alignment element 92 of the hair container 32 engages the recess-shaped positioning element 78 of the attachment comb 30. Further, a lateral cross-section of the hair compartment 48 is shown in FIG. 10. The hair compartment 48 comprises a trap-like chamber or compartment.

As can be best seen from FIG. 11, the (lateral) snap locking elements 90 of the hair container 32 engage the snap lock elements 76 of the attachment comb. The snap lock elements 76 are arranged as protruding elements. The snap locking elements 90 are arranged as recessed elements. Since at least in some embodiments the attachment comb 30 and the hair container 32 are integrally shaped injection-moulding parts, a certain (elastic) deflection may be effected which enables the snap-on or snap-in mounting and detachment action.

Figure 12:
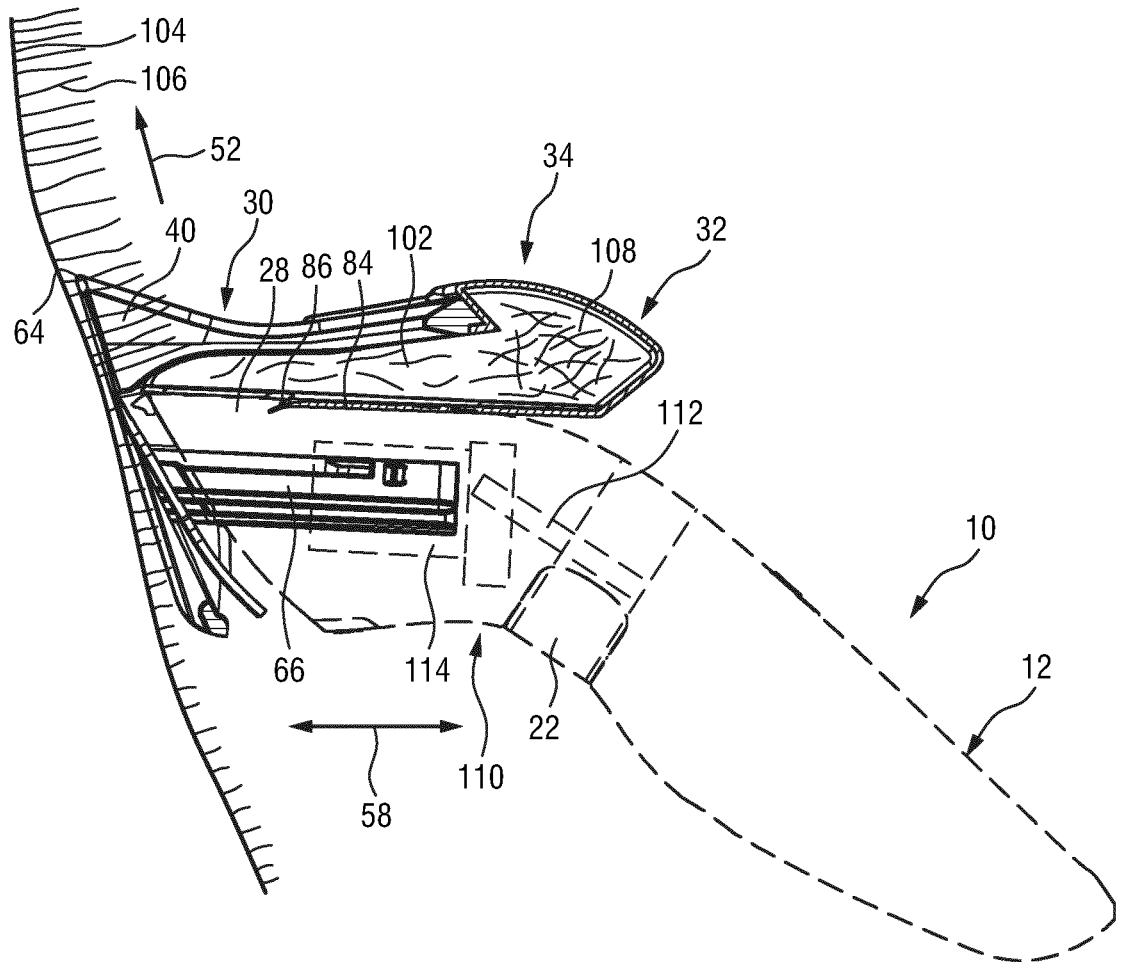
FIG. 12 illustrates a schematic lateral view of a hair cutting appliance that is fitted with an attachment kit including an adjustable attachment comb and a hair container that is attached to the attachment comb; the hair cutting appliance shown in cutting operation.

Reference is still made to FIG. 10 and FIG. 11. Further reference is made to FIG. 12. In FIG. 12, a lateral cross-sectional simplified view of a hair cutting appliance 10 that is fitted with an attachment kit in accordance with the present disclosure is shown, the appliance 10 being used for hair trimming. More particularly, FIG. 10, FIG. 11 and FIG. 12 illustrate a hair guiding channel 102 that is jointly defined by the hair container 32, the attachment comb 30 and, in some respect, by the rear wall 28 of the rear side 26 of the housing 12. For illustrative purposes, the appliance 10, particularly the housing 12 thereof, is shown in FIG. 12 in simplified representation by dotted lines. The appliance 10 is moved in the operating direction 52 through hair 106 at a to-be-groomed skin portion 104. A top end of the attachment comb 30 touches the skin 104.

Hairs 106 may be caught, raked and erected by the ribs 40 of the attachment comb 30. Eventually, the hairs are guided towards the blade set 16 and cut by the cooperating cutting action of the stationary blade and the movable cutter blade thereof. Cut hair sections may then enter the hair guiding channel 102 so as to be guided and moved towards the hair compartment 48, where cut hair sections 108 may accumulate. Preferably, as can be best seen from FIG. 7 and FIG. 8, the lateral catching arms 88 basically close or block the offset gap 98. Therefore, typically only a small number of hairs is missed by the hair container 32.

FIG. 12 further illustrates in a rather simplified block representation an adjustment drive 110 for the adjustable attachment comb 30. The attachment bars 66 of the attachment comb 30 are attached to a carriage 114 which is coupled to a drive shaft 112 which can be operated through the length adjustment control 22. For instance, the length adjustment control 22 is arranged as a control wheel which is coupled to a threadened shaft or nut which may basically translate a rotational input into a transversal output. Via appropriate joints, the carriage 114 which may form part of the mounting receptacle 100 (refer to FIG. 9) may be driven for movement in the adjustment direction 58, either for extending or retracting movement. A resulting relative movement between the attachment comb 30 and the appliance 10 also involves a relative movement between the hair container 32 and the appliance 10 as the hair container 32 is attached to the attachment comb 30. Adjustment movement may involve a sliding relative movement between the guide wall 84, particularly the front end 86 thereof and the rear wall 28 of the housing 12.

While the invention has been illustrated and described in detail in the drawings and foregoing description, such illustration and description are to be considered illustrative or exemplary and not restrictive; the invention is not limited to the disclosed embodiments. Other variations to the disclosed embodiments can be understood and effected by those skilled in the art in practicing the claimed invention, from a study of the drawings, the disclosure, and the appended claims.

In the claims, the word "comprising" does not exclude other elements or steps, and the indefinite article "a" or "an" does not exclude a plurality. A single element or other unit may fulfill the functions of several items recited in the claims. The mere fact that certain measures are recited in mutually different dependent claims does not indicate that a combination of these measures cannot be used to advantage.

Any reference signs in the claims should not be construed as limiting the scope.

The invention claimed is:

1. A hair cutting appliance for a hair cutting operation, the hair cutting appliance comprising:

a cutter configured to cut body hair;

a carriage;

a comb having a comb attachment, wherein the comb is configured to be detachable from and removably attachable to the carriage, the comb having front ribs, wherein the front ribs are configured to contact the body hair during the hair cutting operation; and a hair container configured to be removably attachable to the comb, the hair container comprising:

a container housing comprising a hair compartment, the hair compartment being for storage of cut hair sections, the hair compartment being open at a first portion of the container housing, the first portion leading to an entrance of a second portion of the container housing opposite the first portion, the second portion being closed on all sides except the entrance to trap the cut hair sections, the second portion being further away from the front ribs of the comb than the first portion of the container housing, the first portion being next to the front ribs, and the first portion being configured to pass the cut hair sections to the hair compartment for the storage of the cut hair sections; and an attachment portion configured to removably attach the hair container to the comb, wherein the hair container is removably and indirectly attachable to the carriage via the comb attachment of the comb, and wherein the comb attachment is different from the attachment portion of the hair container.

2. The hair cutting appliance as claimed in claim 1, wherein the hair container is configured to be at least sectionally interposed between a housing portion of the hair cutting appliance and the comb, when the comb attachment of the comb is attached to the carriage of the hair cutting appliance, wherein the carriage is coupled to a drive shaft of the hair cutting appliance, and wherein the drive shaft is operable through a length adjustment control of the hair cutting appliance.

3. The hair cutting appliance as claimed in claim 1, wherein the attachment portion of the hair container comprises at least one lock configured to lock the hair container at the comb in a releasable fashion.

4. The hair cutting appliance as claimed in claim 3, wherein the attachment portion of the hair container comprises at least one aligner configured to engage a mating positioner of the comb.

5. The hair cutting appliance as claimed in claim 1, wherein the attachment portion of the hair container comprises at least two lateral locks that are spaced apart from one another and that are configured to engage mating snap locks at the comb.

6. The hair cutting appliance as claimed in claim 1, wherein the hair container is configured, in a mounted state mounted to the comb, to be moved with the comb relative to a housing portion of the hair cutting appliance, when the comb is moved for comb length adjustment.

7. The hair cutting appliance as claimed in claim 1, wherein the hair container comprises a guide wall, wherein the guide wall, in a mounted state of the hair container mounted to the comb, is arranged between rear ribs of the comb and a rear side of a housing portion of the hair cutting appliance, and wherein the guide wall is configured to guide the cut hair sections to the hair compartment.

8. The hair cutting appliance as claimed in claim 1, wherein the hair container comprises two lateral catching arms which are flexible and laterally delimit a hair guiding channel.

9. The hair cutting appliance as claimed in claim 1, wherein the hair compartment is flexible.

10. A hair cutting appliance for a haft cutting operation, the hair cutting appliance comprising:

a housing;

a cutter including a blade set, the blade set configured to cut hair; and an attachment kit attachable to the housing, the attachment kit comprising:

a haft container; and a comb having a comb attachment and configured to be attachable to the housing leaving a space between the comb and the housing, the comb having ribs configured to contact the hair during the hair cutting operation using the haft cutting appliance with the comb attached to the housing, wherein the hair container includes a container housing, an attachment portion configured to attach the hair container to the comb, and two lateral catching arms, the container housing having a hair compartment for storage of cut hair sections, wherein the hair compartment is formed by the two lateral catching arms, a guide wall, a rear will and a bottom wall between the rear wall and the guide wall, wherein the guide wall, the bottom wall and the rear wall partially enclose the hair compartment leaving open the attachment portion at a first portion of the haft compartment, the first portion leading to an entrance of a second portion of the hair compartment, the first portion being next to the ribs when the hair container is attached to the comb and the first portion being configured to pass the cut hair sections to the hair compartment for the storage of the cut hair sections, wherein the second portion of the haft compartment is dosed on all sides except the entrance to trap the cut hair sections, the second portion being located opposite the first portion of the hair compartment, and the second portion being further away from the ribs of the comb than the first portion of the hair compartment, and wherein the two lateral catching arms laterally delimit a hair guiding channel and the guide wall delimits the hair guiding channel between the two lateral catching arms, the two lateral catching arms and the guide wall forming a boundary that doses the space between the comb and the housing.

11. The hair cutting appliance as claimed in claim 10, wherein the comb is an adjustable comb, and wherein the comb is configured to engage an adjustment drive of the hair cutting appliance.

12. The hair cutting appliance as claimed in claim 10, wherein the comb comprises an end portion, and wherein the hair container is configured to partially fit between the end portion of the comb and the housing.

13. The hair cutting appliance as claimed in claim 10, wherein the comb is arranged as an integrally shaped injection molded part, and wherein the hair container is arranged as an integrally shaped injection molded part.

14. The hair cutting appliance as claimed in claim 10, wherein the hair guiding channel is configured to guide the cut hair sections to the haft compartment when the comb is mounted to the housing.

15. The haft cutting appliance of claim 10, wherein the attachment portion of the haft container is configured to indirectly attach the haft container to the housing via the comb when the comb is attached to the housing by the comb attachment which is different from the attachment portion of the hair container.

16. The hair cutting appliance of claim 10, wherein the attachment portion comprises at least two lateral locks that are spaced apart from one another and that are configured to engage mating snap locks at the comb.

17. The hair cutting appliance of claim 10, wherein the attachment portion comprises at least one aligner configured to engage a mating positioner of the comb.

18. A hair cutting appliance for a hair cutting operation, the hair cutting appliance comprising:

a housing portion configured to house a mounting receptacle;

a cutting unit including a blade set, the blade set configured to cut hair;

a detachable comb having a comb attachment, the detachable comb being configured to be attachable to and detachable from the mounting receptacle, the detachable comb having ribs configured to contact the hair during the hair cutting operation; and a hair container configured to be attachable to and detachable from the detachable comb, wherein the hair container includes a container housing, an attachment portion configured to attach the hair container to the detachable comb of the hair cutting appliance, and two lateral catching arms which laterally delimit a hair guiding channel, the container housing having a hair compartment for storage of cut hair sections, wherein the hair compartment is formed by the two lateral catching arms, a guide wall, a rear wall and a bottom wall between the rear wall and the guide wall, wherein the guide wall, the bottom wall and the rear wall partially enclose the hair compartment leaving open the attachment portion at a first portion of the hair compartment, the first portion leading to an entrance of a second portion of the hair compartment for receiving the cut hair sections through the first portion, wherein the second portion of the hair compartment is closed on all sides except the entrance to trap the cut hair sections, the second portion being located opposite the first portion of the hair compartment, the second portion being further away from the ribs of the detachable comb than the first portion of the hair compartment, wherein the first portion is next to the ribs, and the first portion is configured to pass the cut hair sections to the hair compartment for the storage of the cut hair sections, and wherein the attachment portion of the hair container is configured to indirectly attach the hair container to the housing portion via the detachable comb when the detachable comb is attached to the housing portion by the comb attachment which is different from the attachment portion of the hair container.

19. The hair cutting appliance of claim 18, wherein the attachment portion comprises at least two lateral locks that are spaced apart from one another and that are configured to engage mating snap locks at the detachable comb.

20. The hair cutting appliance of claim 18, wherein the hair container is configured, in a mounted state mounted to the detachable comb, to be moved with the detachable comb relative to the housing portion of the hair cutting appliance, when the detachable comb is moved for comb length adjustment.

* * * * *